United States Patent [19]

Fujimura et al.

[11] Patent Number: 5,016,882

[45] **Date of Patent: * May 21, 1991**

[54] METALLIC GOLF CLUB HEAD

[75] Inventors: Masaki Fujimura; Toyohiko Tadokoro, both of Shizuoka, Japan

[73] Assignee: Yamaha Corporation, Japan

[ * ] Notice: The portion of the term of this patent subsequent to Jul. 18, 2006 has been disclaimed.

[21] Appl. No.: 346,910

[22] Filed: May 3, 1989

Related U.S. Application Data

[62] Division of Ser. No. 113,441, Oct. 23, 1987, Pat. No. 4,848,747.

[30] Foreign Application Priority Data

Oct. 24, 1986 [JP] Japan ..... 61-163233
Dec. 23, 1986 [JP] Japan ..... 61-197637

[51] Int. Cl.[5] ..... A63B 53/04
[52] U.S. Cl. ..... 273/167 H; 273/169
[58] Field of Search ..... 273/167 R, 167 F, 167 H, 273/167 J, 169, 77 H

[56] References Cited

U.S. PATENT DOCUMENTS

| | | | |
|---|---|---|---|
| 3,810,631 | 5/1974 | Braly | 273/167 F |
| 4,322,083 | 3/1982 | Imai | 273/167 F |
| 4,653,756 | 3/1987 | Sato | 273/169 |
| 4,747,599 | 3/1988 | Antonious | 273/169 |
| 4,792,139 | 12/1988 | Nagasaki et al. | 273/167 H |
| 4,798,383 | 1/1989 | Nagasaki et al. | 273/167 H |
| 4,826,172 | 5/1989 | Antonious | 273/169 |
| 4,848,747 | 7/1989 | Fujimura | 273/77 A |

*Primary Examiner*—Edward M. Coven
*Assistant Examiner*—Raleigh W. Chiu
*Attorney, Agent, or Firm*—Lerner, David, Littenberg, Krumholz & Mentlik

[57] ABSTRACT

In construction of a metallic gold club head having a rear side recess and a composite face situated in front of the rear side recess, the position of the composite face is biased towards the toe or heel depending on the number of the club head in order to assure stabilized course of travel traced by balls, increased distance of travel traced by balls and crisp feel at shot of balls.

6 Claims, 3 Drawing Sheets

METALLIC GOLF CLUB HEAD

This is a division of application Ser. No. 07/113,441, filed Oct. 23, 1987, now U.S. Pat. No. 4,848,747.

The present invention relates to an improved metallic golf club head, and more particularly relates to improvements in weight distribution of a metallic golf club head such as an iron club head and a putter having a rear side recess.

Metallic golf clubs are roughly classified into two major categories, i.e. iron clubs and putters. In either case, efforts in production are much directed to stabilized course of travel to be traced by balls, increased distance of travel to be traced by balls and crisp feel at shot of balls.

In the case of iron golf clubs, the length of a club changes stepwise depending on the number of the club. That is, the longer the club, the smaller the number of the club. Long irons include Nos. 1 to 4 irons, middle irons include Nos. 5 to 7 irons and short irons include Nos. 8 to 10 irons. Usually, course of travel traced by balls shot by an iron has its own bias according to its classified length. In case of a right-handed golfer, balls shot by long irons tends to follow rightward courses whereas balls shot by short irons tend to follow leftward courses.

In order to mitigate such bias in course of travel, it is proposed to bias the position of the center of gravity off the geometrical center of a golf club head. In the case of long irons, the center of gravity is biased towards the toe of the club head. Whereas, in the case of short irons, the center of gravity is biased towards the heel of the club head. More specifically, a recess is formed in the rear side of the main body of a club head and the position of the recess is biased towards the heel in the case of long irons and towards the toe in the case of short irons, thereby adjusting the position of the center of gravity.

In the case of this proposal, however, the depth of the rear side recess is limited from the viewpoint of the mechanical strength of the club head. Thus, adjustment in center of gravity cannot be practiced with full satisfaction. In other words, the course of travel to be traced by balls cannot be sufficiently stabilized. Further, presence of such a rear side recess reduces impact at shot of balls and, as a consequence, results in relatively short distances of travel to be traced by balls.

In addition to club heads fully made of metal such as cast iron and stainless steel, it is recently proposed to use so-called composite club heads in which metal is combined with highly elastic CFRP (carbon fiber reinforced plastics). One of such composite club heads is disclosed in Japanese Patent Application Sho. 60-214,297 filed on 27th September, 1985. In the case of this prior application, a recess is formed in the rear side of the main body of a metallic club head at a position corresponding to the club face and a CFRP backing is attached to the bottom of the rear side recess. A fastener ring is further set in the recess in order to fix the position of the CFRP backing. This composite construction is employed mainly for the purpose of reducing the weight of the club head. Lowering in mechanical strength due to presence of the rear side recess is made up for by attachment of the CFRP backing. Reduction in energy loss at impact assures increased distance of travel traced by balls and weight distribution towards the periphery of the main body enlarges the sweet spot of the club head.

The present invention relates to a further improvement of the club head of such a prior application.

In the case of putters, various constructions are proposed in order to stabilize the course of travel to be traced by balls. A toe-heel type putter is provided with an enlarged sweet spot in order to increase inertia moment at shooting balls. A cash-in type putter is provided with a sweet spot focalized at the center of the main body in order to assure crisp feel at shot of balls. The enlarged sweet spot of the toe-heel type putter, however, tends to cause dull feel at shot of balls. Whereas, the focalized sweet spot of the cash-in type putter cannot assure sufficiently stabilized course of travel to be traced by balls.

In addition to putters fully made of metal such as cast iron and stainless steel, it is also proposed to use so-called synthetic putters in which the main body of a putter is made of CFRP (carbon fiber reinforced plastic). Despite the merit of light weight, such synthetic putters cannot sufficiently assure stabilized course and increased distance of travel to be traced by balls and crisp feel at shot of balls.

The present invention relates to a further improvement of such synthetic putters.

SUMMARY OF THE INVENTION

It is the basic object of the present invention to provide a metallic golf club head with stabilized course and increased distance of travel to be traced by balls and crisp feel at shot of balls.

It is another object of the present invention to further improve the functional qualities of a composite type iron golf club head.

It is another object of the present invention to further improve the functional qualities of a golf putter.

In accordance with the basic aspect of the present invention, a metallic golf club head is provided with a composite face situated in front of its rear side recess and its position is biased towards the toe or the heel depending on the number of the club head.

DESCRIPTION OF THE PREFERRED EMBODIMENTS

Figure 1:
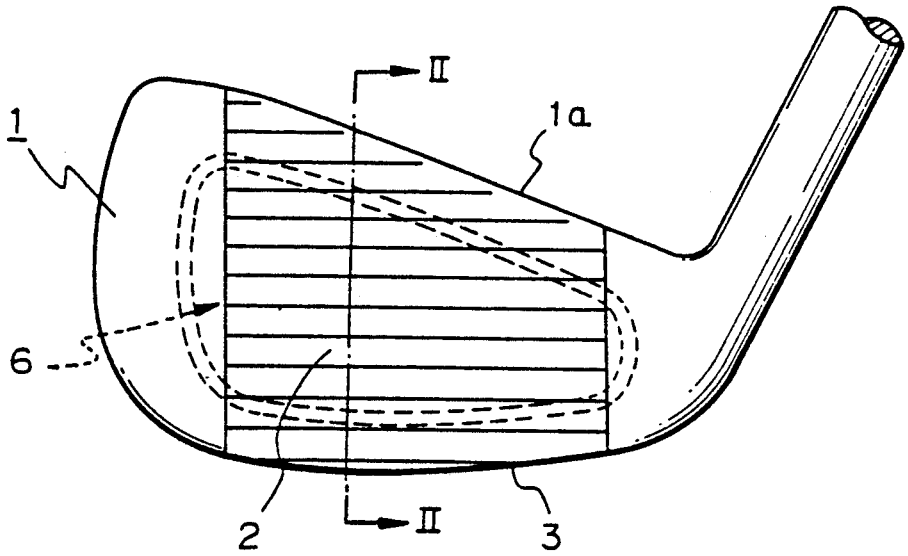
FIG. 1 is a front view of one embodiment of the present invention applied to an iron club head.
Figure 2:
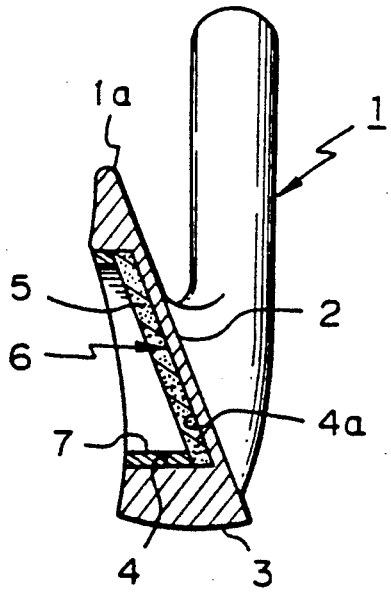
FIG. 2 is a sectional view taken along a line II—II in FIG. 2.

In the embodiment shown in FIGS. 1 and 2, the present invention is applied to an iron golf club head. The main body 1 of the iron club head includes a club face 2 whose thickness gradually increases from the top edge 1*a* to a sole 3, as shown in FIG. 2, with a loft angle inherent to the number of the club. On the rear side of club face 2 is formed a recess 4 in the main body 1 with a flat bottom 4a. The thickness between the club face 2 and the bottom 4a is almost uniform over the entire height of the recess 4. A CFRP backing 5 is tightly attached to the bottom 4a in the recess 4 to form a double-layered composite club face 6. A ring 7 made of metallic or synthetic material is force inserted into the recess 4 in order to fix the position of the CFRP backing 5.

Figure 3:
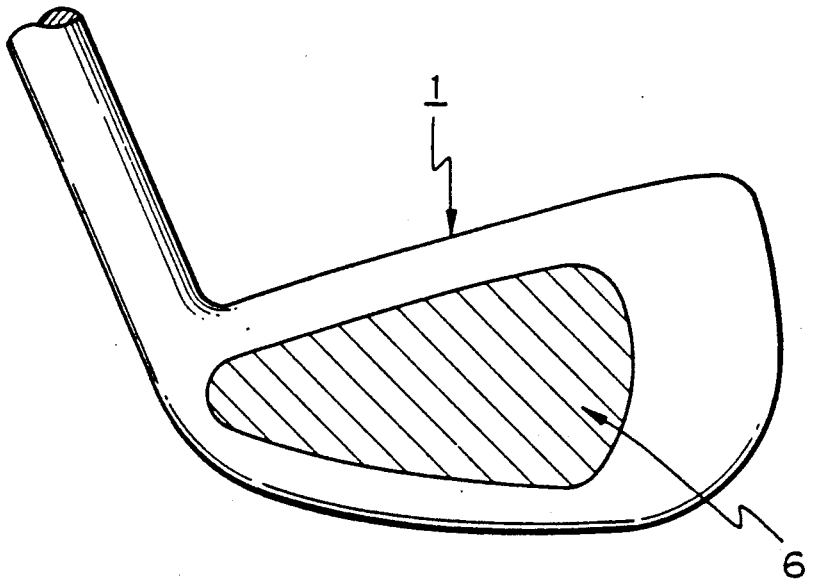
FIG. 3 is an explanatory front view of a long iron club head for showing the position of the club face.
Figure 4:
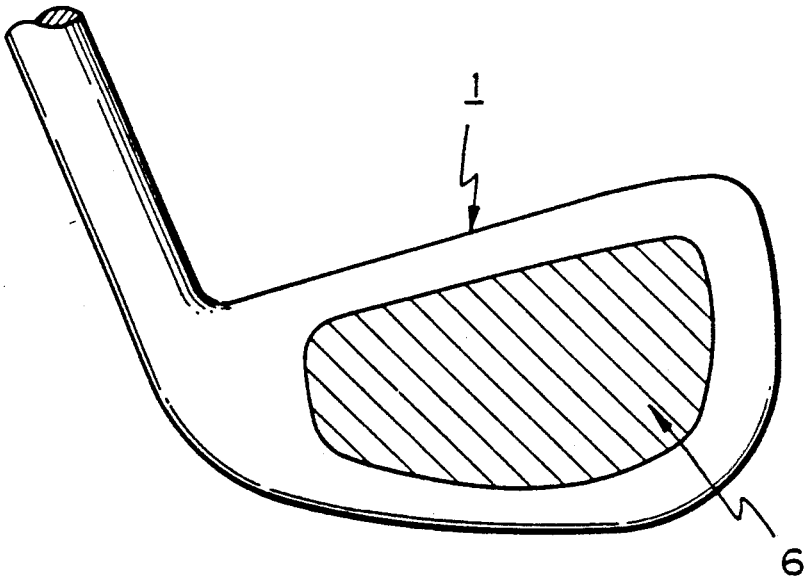
FIG. 4 is an explanatory front view of a short iron club head for showing the position of the club face.

In accordance with the present invention, the position of the above-described composite club face 6 is biased towards the heel or the toe of the club head. More specifically, in the case of a long iron golf club, the position of the composite club face 6 is biased towards the heel of the club head as shown in FIG. 3. Whereas, in the case of a short iron golf club, the position of the composite club face 6 is biased towards the toe of the club head as shown in FIG. 4. Here, term "the position of the composite club face" refers more exactly to "the center of the primary moment of the club face 2 accompanied with the CFRP backing 5". Thus, the larger is the number of a golf club, the more is the position of the composite club face baised towards the toe of the club head for adjustment in position of the center of gravity of the club head.

The thickness between the club face 2 and the bottom 4a of the recess 4 should preferably be in a range from 0.5 to 3.0 mm, and the thickness of the CFRP backing 5 should preferably be in a range from 1.0 to 5.0 mm. The weight of the club head reducible by attachment of the CFRP backing 5 can be distributed to the periphery of the main body 1 in order to enlarge the sweet spot.

Various textile materials can be used for the CFRP backing in various forms. For example, multi-layered reinforcing fibers may be impregnated with epoxy or unsaturated polyester resin. Sheets of reinforcing fibers may be sandwiched after impregnation with proper synthetic resins. Fibers may be used in the form of either a flat cloth or a three-dimensional cloth such as a hollow cloth. Using carbon fibers as the main component, the backing may further contain aromatic polyamide fibers, glass fibers, boron fibers, silicon-carbide fibers and alumina fibers. Not only cloths, but also rovings and mats may be used either solely or in combination.

Figure 5:
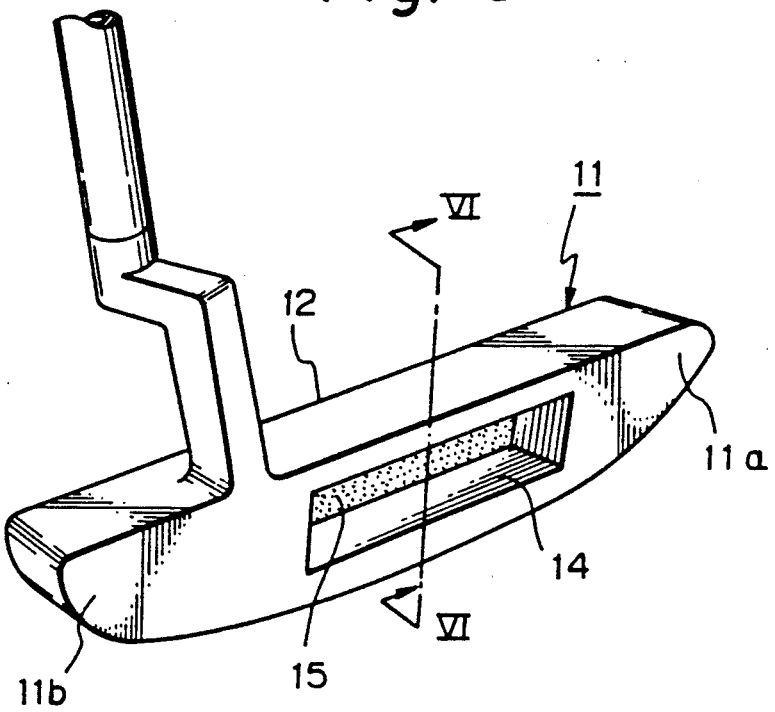
FIG. 5 is a perspective view of another embodiment of the present invention applied to a putter.
Figure 6:
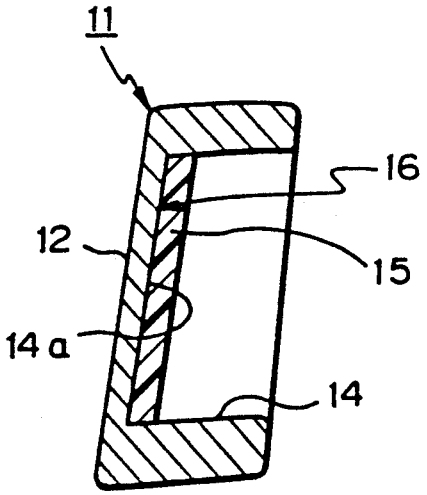
FIG. 6 is a sectional view taken along a line VI—VI in FIG. 5.
Figure 7:
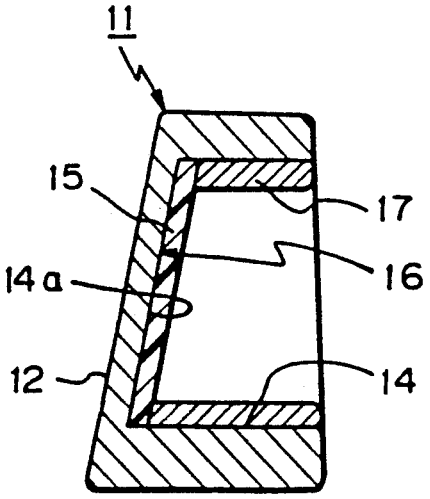
FIG. 7 is a sectional view of one modification of the putter shown in FIG. 6.

In the embodiment shown in FIGS. 5 and 6, the present invention is applied to a putter head. The main body 11 of the putter head includes a putter face 12 and a recess 14 formed on the rear side of the putter head 11. The thickness between the putter face 12 and the bottom 14a of the recess is almost uniform over the entire height of the recess 14. A CFRP backing 15 is tightly attached to the bottom 14a in the recess 14 to form a double-layered composite putter face 16. A ring 17 made of metallic or synthetic material may be force inserted into the recess 14 as shown in FIG. 7 in order to fix the position of the CFRP backing 15.

In accordance with the present invention, the position of the above-described composite putter face 16 is biased towards the heel 11b or the toe 11a of the putter head depending on the number of the putter. The weight of the putter head reducible by attachment of the CFRP backing can be distributed to the periphery of the main body 11 in order to enlarge the sweet spot.

We claim:

1. A metallic golf club head comprising a main body member having a front side, a rear side, a toe and a heel, said main body having a lateral axis extending between said toe and said heel and a predetermined central location centrally located between said toe and said heel along said lateral axis, said rear side including a recess, said front side including a wall section having an inner surface in communication with said recess and a shooting surface remote from said inner surface, said recess having a predetermined length defined by two recess ends and a recess center between said recess ends, said recess center being in a predetermined laterally offset position with respect to said predetermined central location along said lateral axis thereby offsetting said recess laterally between said toe and said heel, said laterally offset position providing the optimum center of gravity of said golf club head so that a ball struck with said shooting surface will travel a substantially stabilized course.

2. The golf club head claimed in claim 1, wherein said recess is offset towards said toe of said golf club head.

3. The golf club head claimed in claim 1, wherein said recess is offset towards said heel of said golf club head.

4. The golf club head claimed in claim 1, including a reinforcement member connected to said inner surface within said recess so as to form a composite front side of said golf club head.

5. The golf club head claimed in claim 4, wherein said reinforcement member is a fiber reinforced plastic.

6. The golf club head claimed in claim 4, wherein said reinforcement member is a carbon fiber reinforced plastic.

* * * * *

UNITED STATES PATENT AND TRADEMARK OFFICE

CERTIFICATE OF CORRECTION

PATENT NO. : 5,016,882

DATED : May 21, 1991

INVENTOR(S) : Masaki Fujimura; Toyohiko Tadokoro

It is certified that error appears in the above-identified patent and that said Letters Patent is hereby corrected as shown below:

Title Page:
In the Abstract, line 1, "gold" should read --golf--.
Column 1, after line 4, insert --BACKGROUND OF THE INVENTION--.

Signed and Sealed this

Twentieth Day of October, 1992

*Attest:*

DOUGLAS B. COMER

*Attesting Officer*

*Acting Commissioner of Patents and Trademarks*